US011412790B2

(12) United States Patent
Qu et al.

(10) Patent No.: US 11,412,790 B2
(45) Date of Patent: Aug. 16, 2022

(54) PERFUMED DUST MASK

(71) Applicant: Honeywell International Inc., Morris Plains, NJ (US)

(72) Inventors: Rocky Qu, Shanghai (CN); Jex Zhang, Shanghai (CN); Zhao Xia Jin, Shanghai (CN)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 365 days.

(21) Appl. No.: 15/775,093

(22) PCT Filed: Nov. 13, 2015

(86) PCT No.: PCT/CN2015/094579

§ 371 (c)(1),
(2) Date: May 10, 2018

(87) PCT Pub. No.: WO2017/079973

PCT Pub. Date: May 18, 2017

(65) Prior Publication Data

US 2018/0368492 A1 Dec. 27, 2018

(51) Int. Cl.
*A41D 13/11* (2006.01)

(52) U.S. Cl.
CPC ..... *A41D 13/113* (2013.01); *A41D 13/1176* (2013.01); *A41D 2400/36* (2013.01); *A41D 2400/42* (2013.01)

(58) Field of Classification Search
CPC .. A41D 13/11; A41D 13/113; A41D 2400/36; A41D 13/1107; A41D 13/1115;
(Continued)

(56) References Cited

U.S. PATENT DOCUMENTS 4,283,011 A * 8/1981 Spector ..... A01M 29/12 239/36
4,921,636 A * 5/1990 Traas ..... G04F 1/02 239/54

(Continued)

FOREIGN PATENT DOCUMENTS

CN 1491703 A 4/2004
CN 1840213 A 10/2006

(Continued)

OTHER PUBLICATIONS

International Application No. PCT/CN2015/094579, International Search Report, dated Aug. 12, 2016, 4 pages.

(Continued)

*Primary Examiner* — Erin Deery
*Assistant Examiner* — Robin Han
(74) *Attorney, Agent, or Firm* — Alston & Bird LLP

(57) ABSTRACT

A face mask comprises a container coupled to a first surface of a face mask, a fragrance material disposed in the container, and an exhalation valve coupled to a second surface of the a face mask. The fragrance material comprises a fluid configured to evaporate from the fragrance material, and the container is configured to releasably engage the exhalation valve to form a closed chamber. The closed chamber is configured to enclose the fragrance material when the container is releasably engaged with the exhalation valve.

19 Claims, 7 Drawing Sheets

(58) Field of Classification Search
CPC ..... A41D 13/1123; A41D 13/1138; A41D 13/1146; A41D 13/1176; A41D 2400/42; A62B 18/02; A62B 18/025; A62B 18/10; A62B 18/00; A62B 18/003; A62B 18/006; A62B 23/02; A62B 23/025; A61M 16/208
USPC ..... 239/35, 36; 128/206.21, 857, 858, 863, 128/206.22, 20.24, 206.12, 207.12; 422/5
See application file for complete search history.

(56) References Cited

U.S. PATENT DOCUMENTS

| | | | | |
|---|---|---|---|---|
| 5,941,244 | A | 8/1999 | Yamazaki et al. | |
| 6,779,524 | B2 * | 8/2004 | Strawder | A61M 16/06 128/206.21 |
| 2008/0121240 | A1 | 5/2008 | Schwarz | |
| 2012/0090615 | A1 * | 4/2012 | Chen | A62B 18/025 128/206.15 |
| 2016/0309702 | A1 * | 10/2016 | Wynalda, Jr. | F01K 5/00 |

FOREIGN PATENT DOCUMENTS

| | | | |
|---|---|---|---|
| CN | 203342149 | U | 12/2013 |
| CN | 203861800 | U | 10/2014 |
| CN | 203897352 | U | 10/2014 |
| CN | 203934690 | U | 11/2014 |
| CN | 204048144 | U | 12/2014 |
| CN | 204048148 | U | 12/2014 |
| CN | 108472521 | A | 8/2018 |
| WO | 2010127161 | A1 | 11/2010 |
| WO | 2011026515 | A1 | 3/2011 |
| WO | 2017079973 | A1 | 5/2017 |

OTHER PUBLICATIONS

International Application No. PCT/CN2015/094579, Written Opinion of the International Searching Authority, dated Aug. 12, 2016, 4 pages.
CN Office Action, including Search Report, dated May 3, 2020 for CN Application No. 201580085705.
English Translation of CN Office Action dated Mar. 3, 2020 for CN Application No. 201580085705.
English translation of CN Search report dated Mar. 3, 2020 for CN Application No. 201580085705.
CN Notice of Allowance dated Aug. 31, 2020 for CN Application No. 201580085705.
CN Office Action, including Search Report, dated Mar. 3, 2020 for CN Application No. 201580085705 (Previously submitted, this is a corrective entry to fix a typo in the date, changing May to Mar.).
English translation of CN Notice of Allowance dated Aug. 31, 2020 for CN Application No. 201580085705.

* cited by examiner

PERFUMED DUST MASK

CROSS-REFERENCE TO RELATED APPLICATIONS

The present application is the National Stage of International Application No. PCT/CN2015/094579 filed on Nov. 13, 2015 and entitled "Perfumed Dust Mask" which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Dust masks, and other face masks, may be worn in various situations, such as in city environments where the ambient air could be dangerous to the user, or work environments, where the user may be exposed to dangerous particles in the air. Masks may be worn over the user's nose and mouth to ensure that the user does not inhale hazardous materials. In some cases, face masks may comprise exhalation valves.

SUMMARY

In an embodiment, a face mask comprises a container coupled to a first surface of a face mask, a fragrance material disposed in the container, and an exhalation valve coupled to a second surface of the a face mask. The fragrance material comprises a fluid configured to evaporate from the fragrance material, and the container is configured to releasably engage the exhalation valve to form a closed chamber. The closed chamber is configured to enclose the fragrance material when the container is releasably engaged with the exhalation valve.

In an embodiment, a method of determining an end of service life of a face mask comprises exposing a fragrance material to an interior of a face mask, vaporizing the fragrance composition while the fragrance material is exposed to the interior of the face mask, evaporating a predetermined quantity of the fragrance composition, and determining an end of service life of the face mask based on evaporating the predetermined quantity of the fragrance composition. The fragrance material initially comprises a predetermined amount of fragrance composition;

In an embodiment, a mask comprises: a container coupled to a first surface of a face mask, a fragrance material disposed in the container, and a visual indicator disposed on an outer surface of the face mask. The fragrance material comprises a fragrance composition configured to evaporate from the fragrance material and provide a scent within an interior of the face mask, and the visual indicator corresponds to the scent provided by the fragrance composition.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
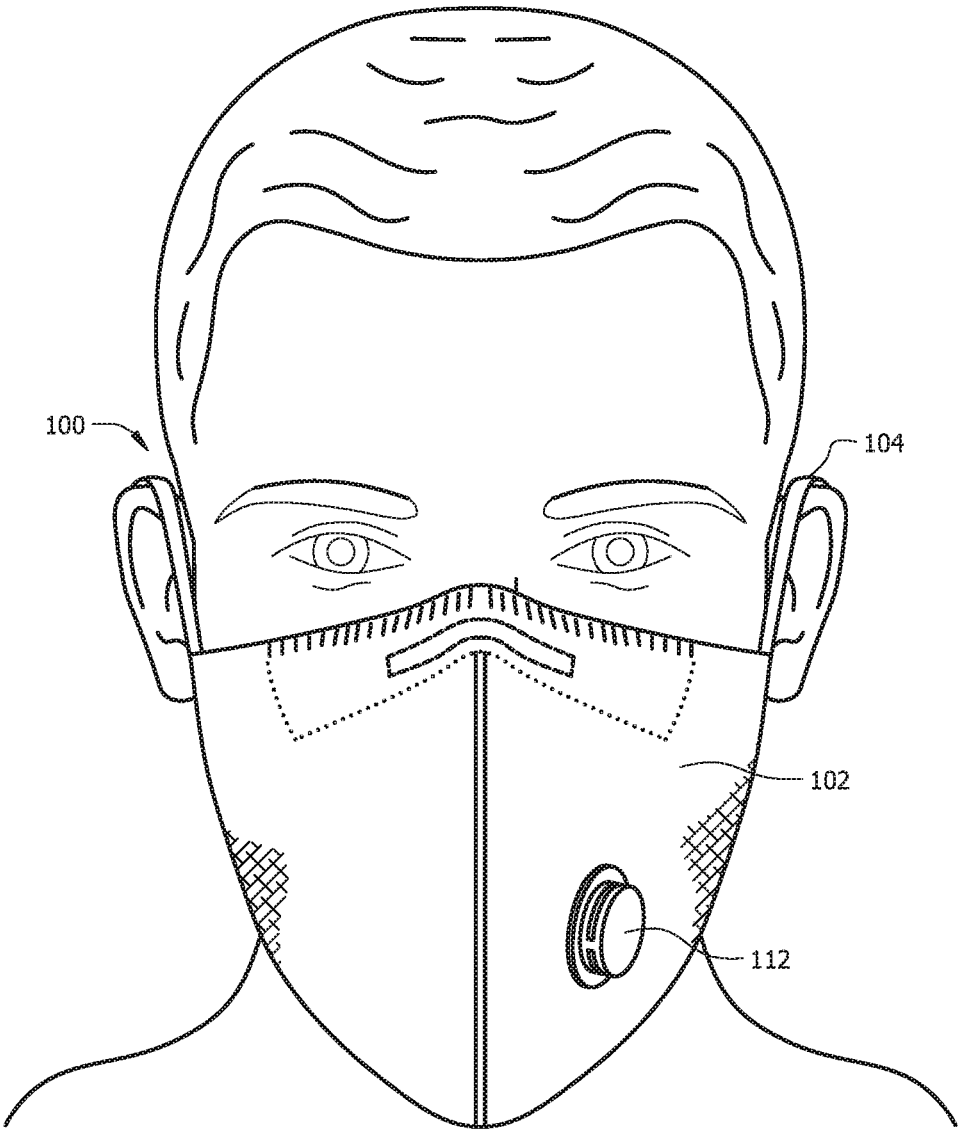
FIG. 1 illustrates a mask according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Disclosed herein is a mask used to filter ambient air for a user. In some environments, the odors present within a working environment may be unpleasant, and workers using masks may prefer to use masks having a scent or fragrance to cover up the odors present in the ambient environment. However, simply including a fragrance within the material of a mask may limit the amount of time the fragrance is available as the fragrance may evaporate prior to the use of the mask. In order to limit the loss of the fragrance, a mask is disclosed that includes a container for a material that releases the fragrance. When the mask is being used, the fragrance material can be exposed to the interior of the mask to provide the fragrance for the user. When the mask is not being used, including prior to the initial use, the container can be closed or sealed to prevent the fragrance from escaping.

In order to provide a convenient seal for the container, a mask having an exhalation valve can use the interior portion of the exhalation valve to effectively seal the container for the fragrance material. In this embodiment, the container can be releasably coupled with the exhalation valve, for example, by folding the mask in half and snap fitting the container to the exhalation valve. The seal element present in the one-way exhalation valve may help seal the fragrance material to retain the fragrance until the mask is used.

Since the fragrance is only released when the mask is in use, the availability of the fragrance can then be used as an end of service life indicator for the mask. In this embodiment, the fragrance material may initially have an amount of the fragrance composition selected to correspond to the service life of the mask. For example, an amount of the fragrance composition can be selected to correspond to an eight hour shift and service life of a mask. The amount of the fragrance can be selected so that when the fragrance released by the fragrance material drops below a olfactory detection threshold, the loss of the scent indicates that the service life of the mask is over. Since the fragrance material can be closed to prevent the loss of the fragrance material when the mask is not being used, periods of non-use or partial use can taken into consideration in the overall end of service life determination.

Still further, the mask may comprise visual indicators on an outer surface of the mask to aid in the selection of the fragrance without the need to expose and partially use the fragrance prior to using the mask. In some embodiments, a visual indicator of the scent can be provided on an outer surface of the mask. For example, a picture of a flower corresponding to the scent can be provided on an outer surface of the mask. In other embodiments, a texture on an outer surface of the mask or an exhalation valve cover can be used to provide a visual and tactile indicator of the scent. These external indicators may make the selection of the mask and the fragrance provided within the mask easier and faster for a user.

Figure 2:
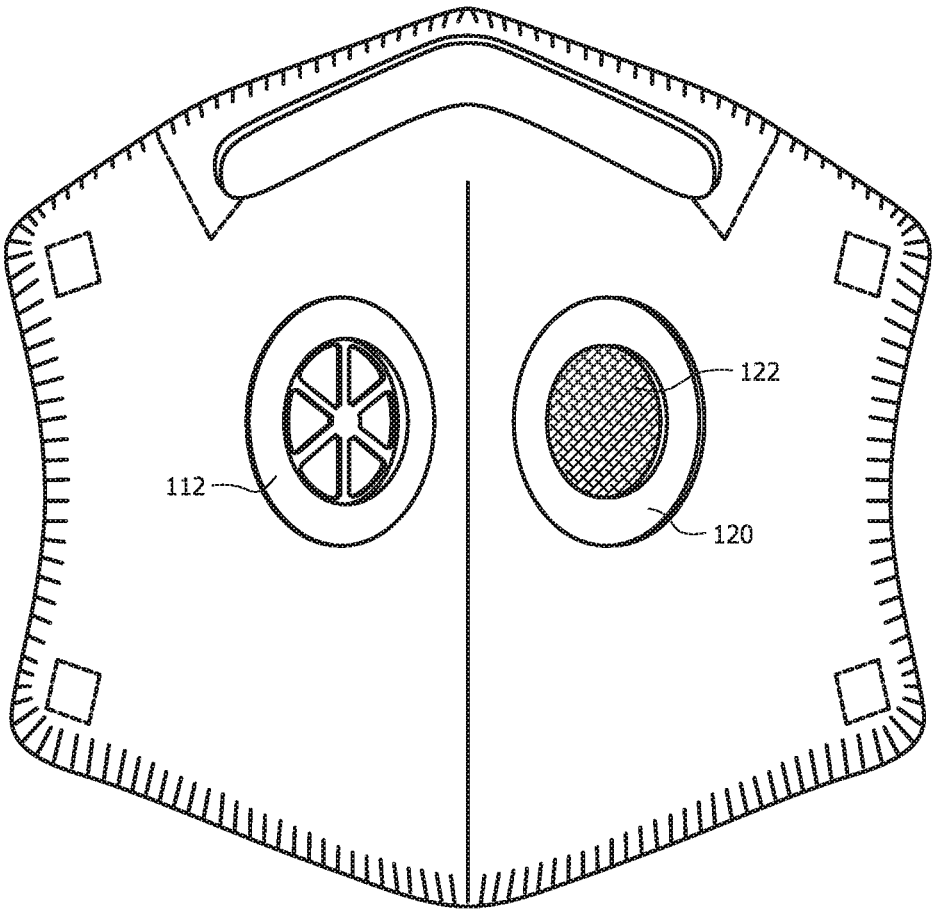
FIG. 2 illustrates another view of a mask according to an embodiment of the disclosure.

FIG. 1 illustrates a perspective view of an exterior surface of a mask 100, and FIG. 2 illustrates a similar view of an interior surface of the mask 100. The mask 100 may comprise a non-woven fabric 102 and be operable to filter dust and/or chemicals from the air. In some embodiments, the mask 100 may be held on the user's face by one or more straps 104. The mask 100 may also comprise an exhalation port 112, with an exhalation valve 110. The exhalation valve 110 may attach to the exhalation port 112, and in some embodiments, the exhalation valve 110 may be substantially permanently attached to the port 112 (e.g., incapable of being removed without damaging the mask to an extent that it is unsuitable for use). The exhalation valve 112 is configured to allow an increased pressure within the mask to be relieved to an external environment while preventing air from entering through the exhalation valve to an interior of the mask 100 when the mask 100 is being worn. A structure for the exhalation valve 112 is described in more detail herein.

Figure 3:
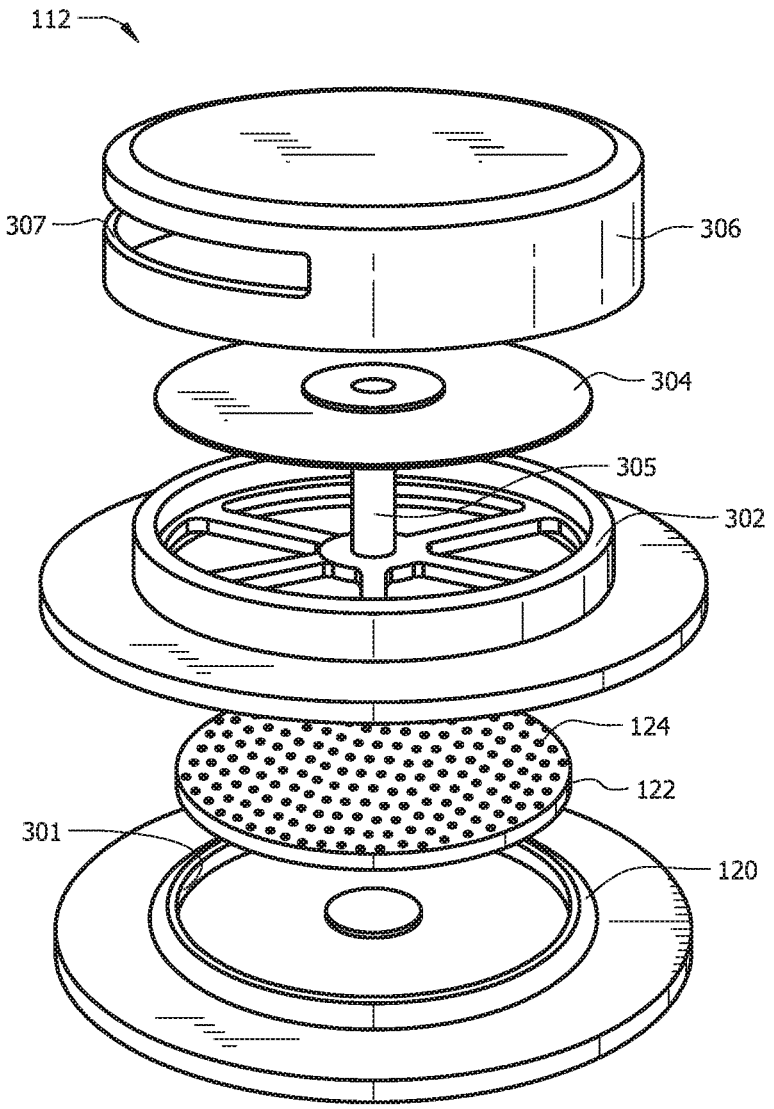
FIG. 3 illustrates an exploded view of an exhalation valve and fragrance container according to an embodiment of the disclosure.

The mask 100 may also comprise a container 120 for retaining a fragrance material 122 within an interior of the mask 100. In an embodiment, the container 120 is configured to retain the fragrance material 122 in position within the interior of the mask 100. In some embodiments, the fragrance material 122 can comprise a polymeric material having a fragrance composition absorbed therein. For example, the polymeric material can be porous and retain the fragrance composition within the open pores of the fragrance material 122. As shown in FIG. 2 and FIG. 3, the fragrance material 122 can comprise a plurality of pores 124 or apertures to increase the surface area of the fragrance material 122 available for the release of the fragrance composition. While described as comprising a polymeric material, the fragrance material 122 can also comprise a woven or non-woven fabric or fiber material, and/or a porous material such as a ceramic or metal.

In some embodiments, the fragrance composition may be soluble within the polymeric material such that the fragrance composition is absorbed within the polymeric material and can be released through a controlled diffusion process. In some embodiments, the fragrance material 122 may comprise a polymer or resin that forms a closed chamber to retain the fragrance composition within the interior of the fragrance material 122. A controlled diffusion through the polymer or resin may then be used to release the vaporous fragrance from the fragrance material while retaining any liquid fragrance composition within the interior of the fragrance material. In still other embodiments, a chamber retaining a fragrance liquid may have one or more apertures configured to retain a liquid within the chamber while allowing a fragrance composition vapor to be released at a controlled diffusion rate through the one or more apertures.

The fragrance composition can comprise any suitable liquid or vapor composition that are used to produce a predetermined fragrance or smell. Such compositions can vary and are generally known in mixtures such as perfumes to produce a desired odor. In some embodiments, the fragrance composition can be produced by a solid material that sublimates to produce the fragrance at the expected operating conditions.

FIG. 3 illustrates a perspective, exploded view of an exhalation valve 112 and the container 120 with the fragrance material 122. As shown, the container 120 may generally comprise a flat base configured to be coupled to an interior surface of the mask. A shoulder 301 can be formed by an outwardly extending wall extending from the base towards the interior of the mask. A chamber or interior space can be formed within the shoulder 301 and the surface of the base. The fragrance material 122 may be relatively flat and form a disk having an outer shape corresponding to the shape of the shoulder 301. The size and shape of the fragrance material 122 can be selected to allow the fragrance material 122 to be inserted into and engaged within the chamber formed by the shoulder 301 and the interior surface of the base. The fragrance material 122 may be sized so that a snap fit or interference fit is created when the fragrance material 122 is engaged with the base.

The exhalation valve 112 is also illustrated in FIG. 3. As shown, the exhalation valve 112 can comprise a valve base 302 a valve plate 304 coupled to the valve base 302 and an optional valve cover 306 coupled to the valve base 302 and enclosing the valve plate 304. The valve base 302 can comprise one or more holes or openings to allow air to pass through the valve base 302 and contact the valve plate 304. The valve plate 304 can be disposed about a center post 305 so that the valve plate 304 engages and forms a seal with an outer surface of the valve base 302. In order to provide a sealing surface, the valve base 302 may have a continuous surface or ring about an edge to allow the valve plate to contact the valve base 302. The valve cover 306 can be press fitted, snap fitted, bonded, or otherwise coupled to the valve base 302. One or more openings 307 can be formed in the valve cover 306 to allow any air passing through the exhalation valve 112 to escape to the ambient environment. The openings 307 may be formed on a side of the valve cover 306 so that a solid surface is formed adjacent the valve plate 304 to protect and prevent potential damage to the valve plate 304 during use.

The valve plate 304 may be formed from a relatively soft and flexible material so that the valve plate 304 can flex in response to an imposed pressure differential across the valve plate 304. In use, a user may exhale a breath into the interior of the mask while the mask is being worn. The increased pressure within the interior of the mask may cause the valve plate 304 to flex outward and create a gap between the valve plate 304 and the valve base 302. The exhaled breath can then escape through the exhalation valve 112 to the ambient environment. As the user inhales, a negative pressure (relative to the ambient environment) is create that causes the valve plate 304 to engage the valve base 302. The seal formed between the valve plate 304 and the valve base 302 may then prevent any ambient air from passing into the interior of the mask through the exhalation valve 112, and rather the air can be drawn through the mask material to provide the desired filtering of the ambient air. While illustrated in FIG. 3 as an exhalation valve 112 having a valve plate 304, any suitable one-way valve can be used in place of the exhalation valve illustrated in FIG. 3.

As shown in FIG. 3, the combination of the container 120 and the exhalation valve 112 can be used to enclose the fragrance material 122 while the mask is not in use. The enclosure of the fragrance material may limit the release of the fragrance composition into the environment to allow the fragrance composition to only be released while the mask is being used. Such a configuration may allow the mask to have the benefit of a fragrance during its useful life without needing to replace or replenish the fragrance composition or fragrance material that could otherwise become depleted when the mask is not being used.

As illustrated, the base of the container 120 can be configured to engage the valve base 302 so that a closed chamber is formed between the base of the container 120, the valve base 302, and the valve plate 304. In this embodiment, the base of the container 120 is a closed surface that prevents the flow of any fluids therethrough. The shoulder 301 can have a corresponding shape to an opening in the interior surface of the exhalation valve 112 so that the shoulder can be coupled with the opening and form an engagement between shoulder 301 and the opening in the interior surface of the exhalation valve 112. When the fragrance material 122 is enclosed within the closed chamber, the valve plate 304 can engage the valve base 302 to form a closed surface over the fragrance material 122.

In use, the container 120 can be coupled to the exhalation valve 112 when the mask is not in use. In this configuration, the fragrance material 122 can be enclosed within the closed chamber formed between the base of the container 120, the valve base 302, and the valve plate 304. While some amount of the fragrance composition within the fragrance material 122 may evaporate and fill the closed chamber, an equilibrium concentration can be established that may limit the amount of the fragrance composition evaporating from the fragrance material 122. As a result, the ability of the fragrance material 122 to produce a fragrance can be maintained while the mask is not in use. When the container 120 is disengaged from the valve base 302, the fragrance composition may continue to evaporate to produce the fragrance within the interior of the mask.

Figure 4A:
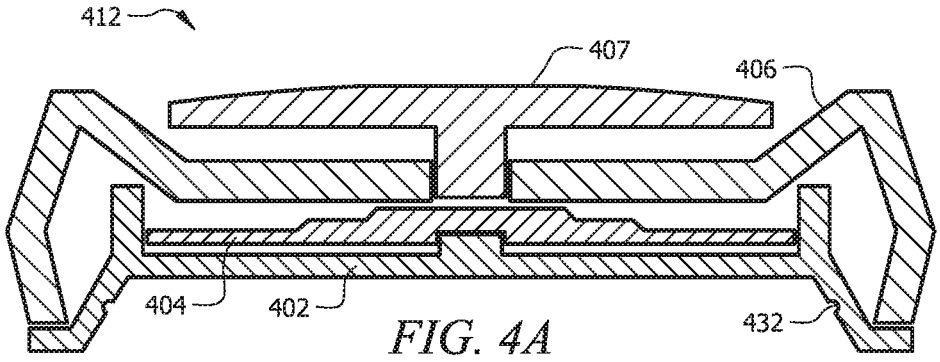
FIGS. 4A and 4B illustrate a cross sectional view of another exhalation valve and fragrance container according to an embodiment of the disclosure.
Figure 4B:
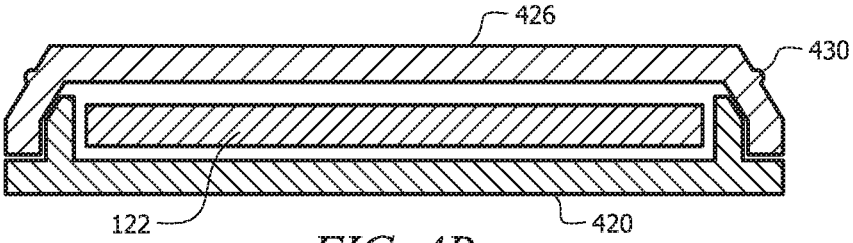

Another embodiment of a container 420 and an exhalation valve 412 are illustrated in the cross-sectional view shown in FIGS. 4A and 4B. The container 420 may be similar to the container 120 described with respect to FIGS. 1-3 and can include the features of the container 120 as described herein. Similarly, the exhalation valve 412 can be the same or similar to the exhalation valve 112 described with respect to FIGS. 1-3 and can include the features of the container 120 as described herein. As shown in FIG. 4B, the container may also comprise a cover 426, and the cover 426 and the valve base 402 may comprise corresponding features to improve the coupling between the two components.

As shown in FIG. 4B, a cover 426 or other retaining structure can be placed over the fragrance material 122 and coupled to the container 420 to retain the fragrance material 122 in the chamber in some embodiments. The cover 426 can have holes, opening, or be permeable to the fragrance vapor to allow the fragrance vapor to pass out of the fragrance material 122 and into the interior of the mask when the mask is being used. The cover 426 can be snap fitted, adhered (e.g., using an adhesive, sonic welding, heat welding, etc.), or otherwise coupled to the base of the container 420 in order to retain the fragrance material 122 in the container 420. In some embodiments, the cover 426 may be removably or releasably coupled to the base of the container 420 in order to allow the fragrance material to be initially placed in the chamber or replaced if the fragrance composition is effectively used up. In some embodiments, the engagement of the cover 426 with the base of the container 420 may form a sealing engagement. When a cover 426 is used with the container 420, the fragrance material 122 may be loosely contained within the chamber and may not be friction fitted into the container 420.

The exhalation valve 412 may be similar to the exhalation valve described with respect to FIG. 3. For example, the exhalation valve 412 can comprise a valve base 402, a valve plate 404 coupled the valve plate 404, and a valve cover 406. The valve plate 404 can operate in the same manner described herein to allow air to pass out of the interior of the mask while substantially preventing air from entering the interior of the mask through the exhalation valve 412. The valve cover 406 as shown in FIG. 4A may comprise openings or holes in an outer surface of the valve cover 406 while having a cover plate 407 to prevent damage from any object directly impacting the valve plate 404.

In order to provide a snap fit between the cover 426 and the valve base 402, a protrusion 430 can be formed on an edge of the cover 426 that is configured to engage a corresponding recess 432 formed in the valve base 402. While the protrusion 430 is shown on the cover 426, the relative position of the protrusion 430 and the recess 432 can be switched with the same effect.

Figure 5:
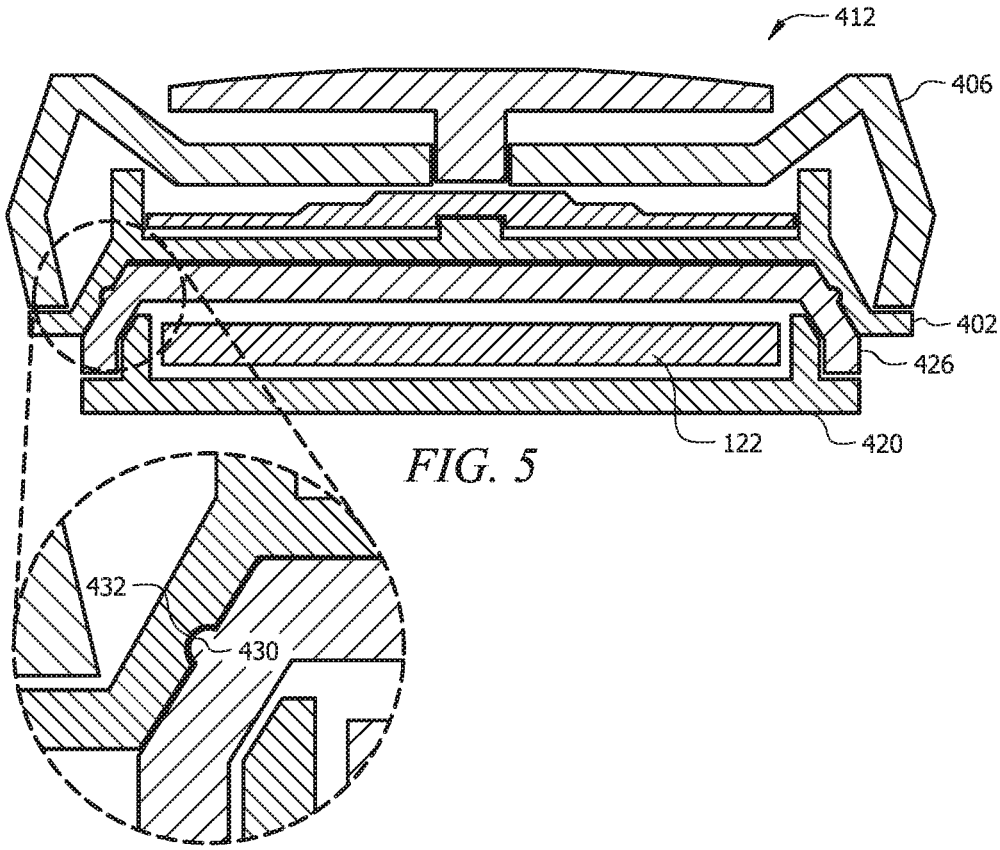
FIG. 5 illustrates another cross sectional view of an exhalation valve and fragrance container according to an embodiment of the disclosure.

FIG. 5 illustrates a cross section of the cover 426 and the base of the container 420 coupled to the exhalation valve 412. As shown, the cover 426 can be inserted into a corresponding opening in the valve base 402. The valve base 402 and/or the cover 426 can be formed from a flexible or semi-flexible material so that as the cover 426 engages the valve base 402, the valve base 402 and/or the cover 426 can flex to allow the protrusion 430 on the cover 426 to pass upwards into the valve base 402. As the cover 426 engages the valve base 402, the protrusion 430 that has been flexed inwards towards the center of the cover 426 can expand or "snap" into the recess 432 to form a releasable engagement between the cover 426 and the valve base 402. The resulting engagement of the protrusion 430 with the recess 432 may aid in forming a seal between the cover 426 and the valve base 402. When the cover 426 is to be removed from the valve base 402, a removal force is applied to flex the protrusion 430 inward to disengage the protrusion 430 from the recess 432.

When the cover 426 is releasably engaged with the valve base 402, the fragrance material 122 can be retained in the closed chamber formed between the base of the container 420, the edge of the cover 426, the edge of the valve base 420 and the valve plate 404. As with the previous embodiments, the close chamber may limit the amount of fragrance composition evaporated from the fragrance material 122 to thereby limit the amount fragrance composition lost when the mask is not in use.

While FIG. 4B illustrates the container 420 being used with the exhalation valve 412, the container 120 illustrated in FIG. 3 and its features can also be used with the exhalation valve 412. Similarly, the container 420 and its features can also be used with the exhalation valve 112 described with respect to FIG. 3. Any of the features used between the embodiments can be interchanged with equivalent effect.

Figure 6:
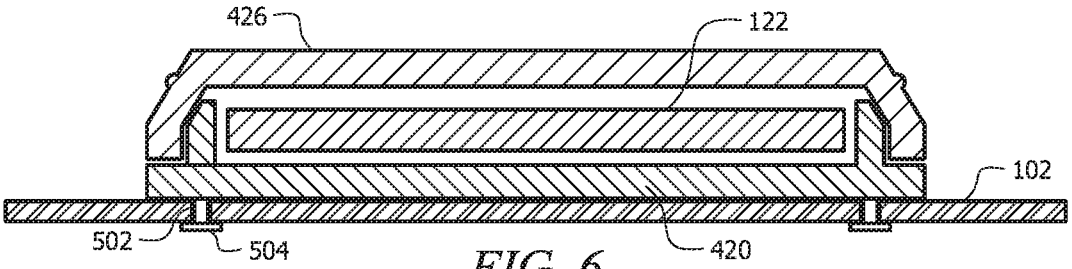
FIG. 6 illustrates a cross sectional view of a fragrance container coupled to a mask according to an embodiment of the disclosure.

In any of the embodiments shown in FIGS. 1-5, the container can be coupled to an inner surface of the mask on a side opposite the exhalation valve. The container can be glued, bonded, stitched, or otherwise coupled to the mask. In some embodiments, a plurality of posts can be used to coupled the container to the mask. FIG. 6 illustrates an embodiment in which the container 420 is coupled to the mask fabric 102. In this embodiment, one or more posts 502 can extend from a surface of the container 420 opposite the side of the container with the fragrance material 122. When the container is placed on an interior of the mask, the posts can extend in a direction that extends from the interior of the mask to an exterior of the mask. The posts 502 can be inserted through the fabric 102 and deformed in order to retain the container 420 in position within the interior of the mask. In an embodiment, the posts can be formed from a thermoplastic, and the posts 502 can be deformed using welding (e.g., sonic welding, etc.), heat, or the like. The process may result in lateral extensions 504 that can prevent the posts 502 from pulling back through the fabric 102. Any suitable number of posts 502 can be used to provide a desired retaining force for the container 420 on the surface of the mask.

While illustrated in terms of the container 420, any of the connection mechanisms for the container with the fabric 102 can be used with any of the containers (e.g., container 120, container 420, etc.) described herein with an equivalent functionality.

Figure 7:
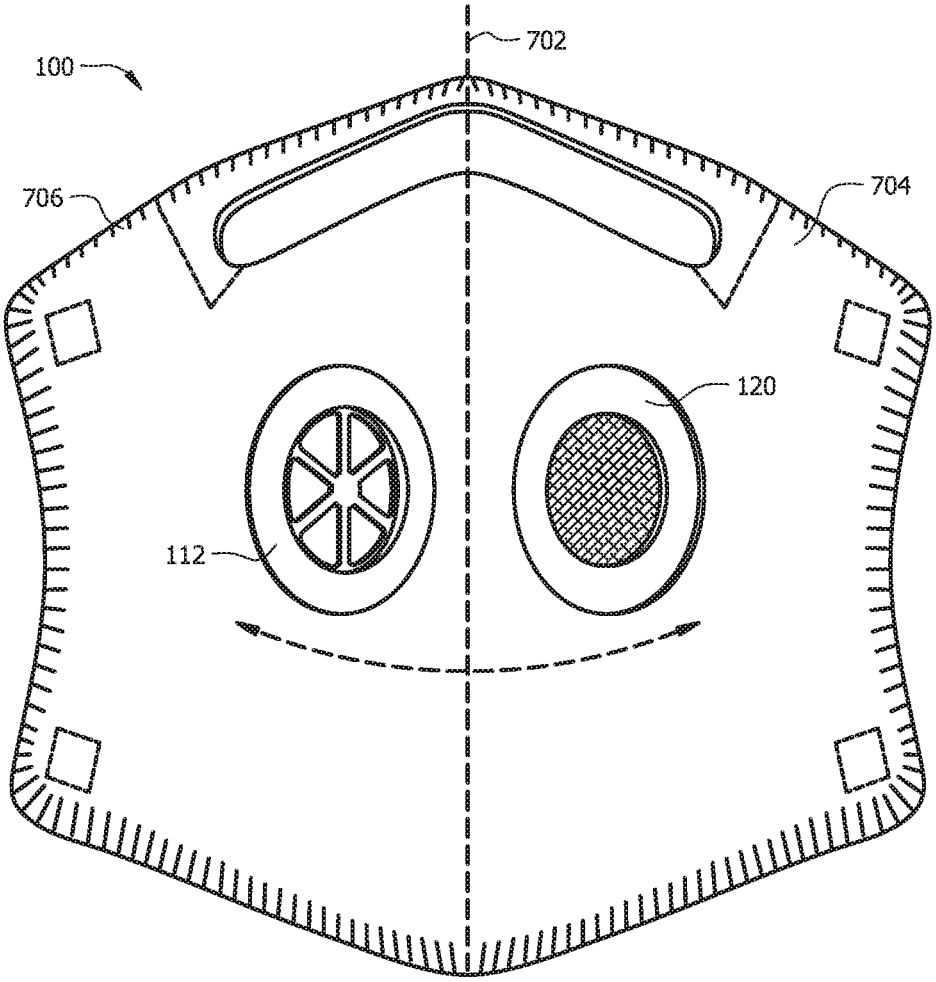
FIG. 7 illustrates still another view of a mask according to an embodiment of the disclosure.

FIG. 7 illustrates an embodiment in which the exhalation valve 112 and the container 120 are placed on opposite sides of the mask 100. As illustrated, a centerline 702 may define a fold line for the mask 100. The fold line may be pressed into the mask during manufacturing or simply represent a centerline at which the customer can fold the mask 100. The centerline 702 may define a first half 704 of the mask and a second half 706 of the mask 100. The container 120 can be coupled to the first half 704 of the mask 100, and the exhalation valve 112 can be coupled to the second half 706 of the mask. The container 120 and the exhalation valve 112 can be located so that the container can be releasably coupled with the exhalation valve 112 when the mask is folded in half along the centerline 702. This may provide an easy open and close function for the container to preserve the fragrance composition when the mask is not in use.

While FIG. 7 is described with respect to the exhalation valve 112 and the container 120, the arrangement illustrated in the embodiment shown in FIG. 7 can also use any combination of the exhalation valves and containers described herein. For example, the exhalation valve 412 and/or the container 420 described with respect to FIGS. 5-6 can be substituted for the exhalation valve 112 and/or the container 120 with an equivalent effect.

Figure 8:
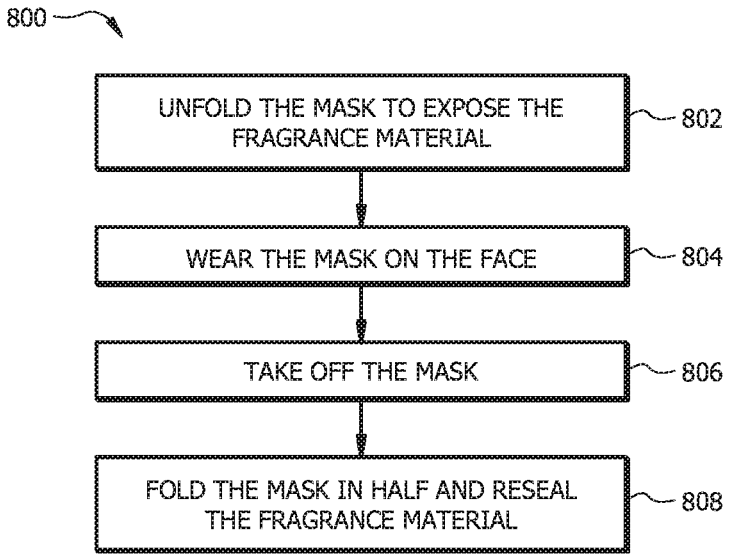
FIG. 8 illustrates a flowchart for a method according to an embodiment of the disclosure.

FIG. 8 illustrates a flow chart for a method 800 of using the mask as described herein. In this embodiment, a user may initially obtain a mask and unfold the mask in order to place the mask on the user's face in step 802. The mask may initially have the container releasably coupled to the exhalation valve, thereby preventing the release of the fragrance. When the user unfolds the mask, the container may be released from the exhalation valve so that the fragrance material is exposed to an interior of the mask.

In step 804, the user may wear the mask on the user's face. When the mask is on the user's face, the fragrance material may be exposed to the interior of the mask. The fragrance composition may evaporate or otherwise release a fragrance from the fragrance material into the interior of the mask. The fragrance may then be detected by the user during use of the mask. In step 806, the user may take the mask off after the desired period of use.

When the user takes off the mask, the user can then fold the mask back in half in step 808. In this process, the user may align and releasably couple the container to the exhalation valve in order to limit the further release of the fragrance from the fragrance material. This may retain the fragrance composition in the fragrance material for the next time the mask is needed. If the fragrance being release by the fragrance material falls below a threshold level, the user may be able to replace the fragrance material so that the fragrance will once again be released. In some embodiments, the threshold may be an olfactory detection threshold. For example, when the user can no longer detect the scent, the user may determine that the fragrance composition is no longer releasing the desired fragrance.

In some embodiments, the scent may be used as an end of service life indicator for the mask. In this embodiment, the service life period for the mask may be a predetermined time limit. The amount of fragrance composition in the fragrance material can then be selected to release the fragrance at the expected conditions in which the mask will be used for a corresponding time frame. The amount of fragrance composition may be selected based on the detection threshold of the fragrance, and in some embodiments, the threshold may correspond to an olfactory detection threshold.

Figure 9:
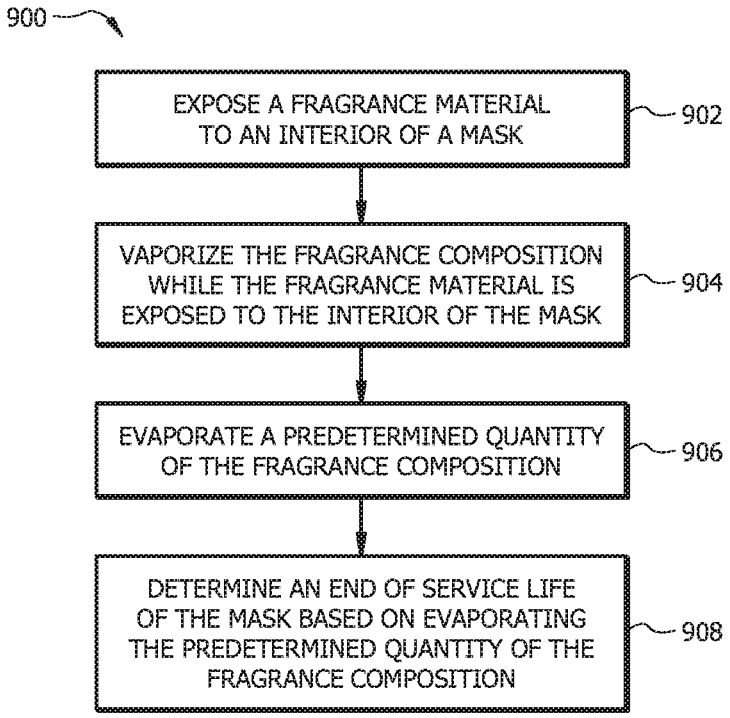
FIG. 9 illustrates a flowchart for a method of determining the end of service life for a mask according to an embodiment of the disclosure.

FIG. 9 illustrates a flow chart of a method 900 for determining the end of the service life of a mask. In this method, the fragrance material can be exposed to an interior of the mask in step 902. The fragrance material may initially comprise a predetermined amount of a fragrance composition. In step 904, the fragrance composition can be vaporized while the fragrance material is exposed to an interior of the mask. A predetermined quantity of the fragrance composition can be evaporated in step 906. In some embodiments, the predetermined quantity can be selected based on an expected evaporation rate at the expected operating conditions of the mask. The predetermined quantity may correspond to an amount of the fragrance composition that is below the olfactory detection limit, which may be less than a complete volatilization of fragrance composition from the fragrance material. The end of the service life can then be determined in step 908 based on the evaporation of the predetermined quantity of the fragrance composition. For example, the end of the service life may be determined when the fragrance composition can no longer be detected.

The service life of the mask, and the corresponding amount of the fragrance composition, may vary depending on the particular type of mask used, the expected environment in which the mask is used, and the like. In some embodiments, the mask may be designed for use with a single shift of between about 6 and about 12 hours, though in other embodiments, time of less than 6 hours or more than 12 hours are also possible. Once the service life period is known, the amount of the fragrance composition can be determined and provided in the fragrance material within the mask.

The method 900 for detecting the end of the service life using the fragrance can be used with a fragrance composition alone and may not need the features described above. In some embodiments, the end of the service life can be determined using the fragrance provided with any of the embodiments described herein. For example, the fragrance material can be retained in a container that can be releasably coupled to an exhalation valve. In this embodiment, the container can be engaged or coupled with the exhalation valve when the mask is not in use as described above. The fragrance composition may be substantially prevented from vaporizing while the container is engaged or coupled with the exhalation valve. When the mask is used again, the container can be disengaged from the exhalation valve to allow the fragrance composition to continue to vaporize. This may allow the end of the service life to be determined by the amount of time the mask is used, rather than an absolute amount of time, where the use of the mask is based on the time the fragrance material is exposed to the interior of the mask. This may advantageously help avoid disposing of masks prior to the actual useful life of the mask.

Figure 10:
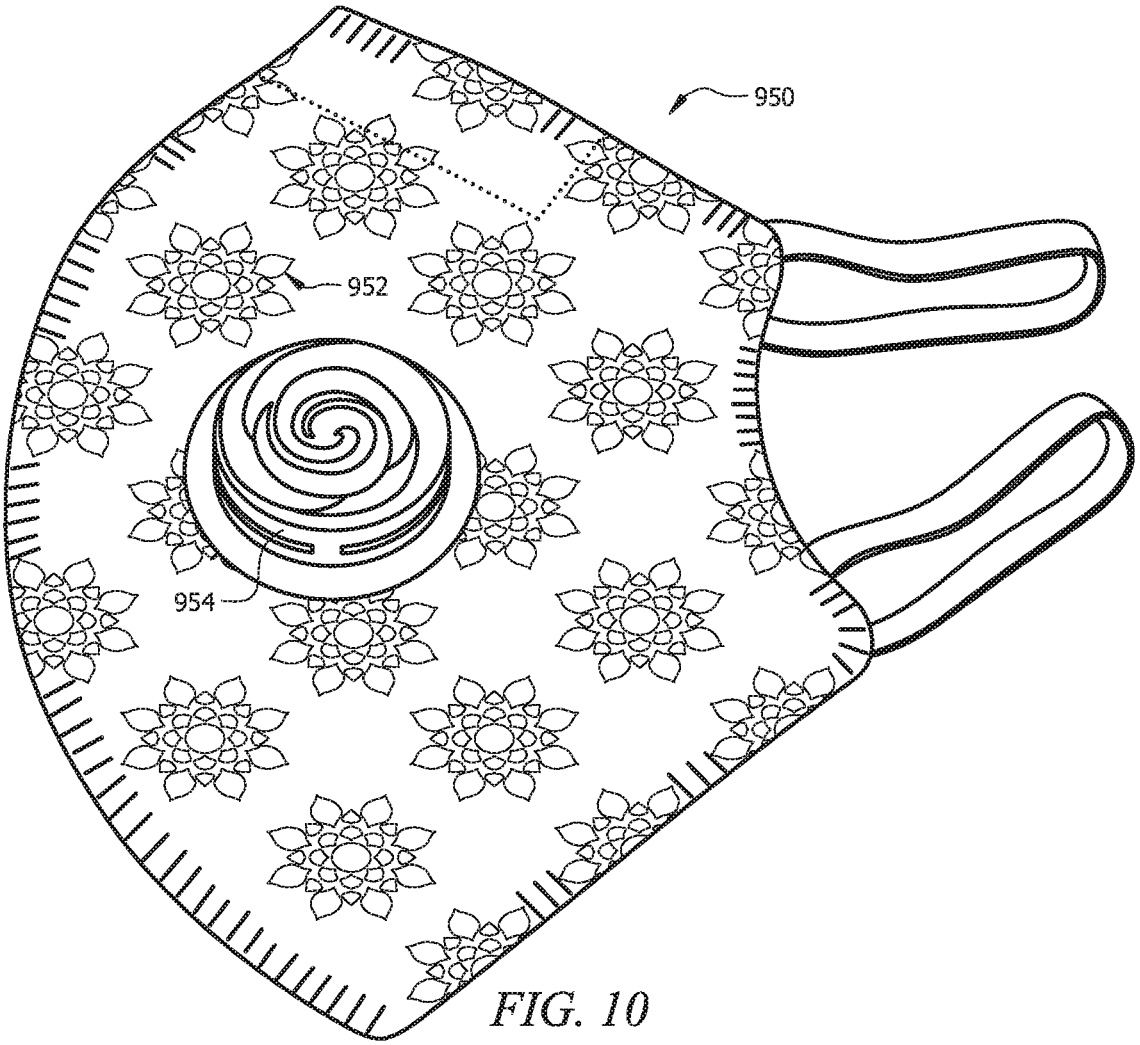
FIG. 10 illustrates a perspective view of a mask having visual indicators of a fragrance according to an embodiment of the disclosure.

In still other embodiments, the mask may comprise features to allow a user to determine the fragrance being used with the mask. FIG. 10 illustrates a perspective view of a mask 950 having a visual indicator 952 corresponding to a fragrance in the mask 950. In this embodiment, the mask 950 may comprise a container as described in any of the embodiments herein with a fragrance composition within the fragrance material. The fragrance composition may correspond to a particular fragrance. In order to aid the user in selecting a mask 950 with a desired fragrance, the outer surface of the mask 950 (e.g., the surface opposite the surface closest to the user's face) can comprise a visual indicator corresponding to the scent provided by the fragrance composition.

In an embodiment, the visual indicator can comprise any suitable indicator that corresponds to the fragrance. In some embodiments, the visual indicator can comprise a picture corresponding to the fragrance. For example, when the fragrance is a flower, one or more pictures or representations of the flower may be provided on the outer surface. Similarly, picture(s) or representation(s) of fruit, plants, or the like can be provided on an outer surface of the mask 950. The visual indicators can be in color, black and white, or any other suitable presentation.

In order to further enhance the indication of the fragrance, an outer surface of the mask 950 can also comprise a texture corresponding to the fragrance. For example, the outer surface of the mask 950 can comprise a texture simulating a fruit such as an orange to provide an indication that the fragrance is an orange fragrance. In some embodiments, the exhalation valve can comprise the valve cover that is visible from an exterior of the mask 950. The exhalation valve cover 954 can comprise the texture to provide a visual and tactile indication of the fragrance provided by the mask 950. For example, the exterior cover can have a texture representing a fruit, the exterior cover 954 can be shaped like a flower corresponding to the fragrance, or any other suitable texture can be placed on the exterior cover 954. The use of the visual indicator and/or a texture may allow a user to properly select a mask 950 without the need to open the mask 950 to test the scent or fragrance prior to using the mask 950.

Having described various embodiments and methods herein, exemplary embodiments can include, but are not limited to:

In a first embodiment, a mask comprises a container coupled to a first surface of a mask, a fragrance material disposed in the container, wherein the fragrance material comprises a fluid configured to evaporate from the fragrance material, and an exhalation valve coupled to a second surface of the a mask, wherein the container is configured to releasably engage the exhalation valve to form a closed chamber, and wherein the closed chamber is configured to enclose the fragrance material when the container is releasably engaged with the exhalation valve.

A second embodiment can include the mask of the first embodiment, wherein the mask comprises a center fold line defining a first half and a second half of the mask, wherein the first surface is on the first half, and where the second surface is on the second half.

A third embodiment can include the mask of the second embodiment, wherein the mask is configured to be folded in half when the container is releasably engaged with the exhalation valve.

A fourth embodiment can include the mask of any of the first to third embodiments, wherein the exhalation valve comprises a valve base and a valve plate coupled to the valve base, wherein the valve plate forms a seal with the valve base, and wherein the container is configured to releasably engage the valve base.

A fifth embodiment can include the mask of the fourth embodiment, wherein the container is configured to releasably engage the valve base using a snap fit.

A sixth embodiment can include the mask of the fourth or fifth embodiment, wherein the closed chamber is formed between the valve plate, the valve base, and the container.

A seventh embodiment can include the mask of any of the first to sixth embodiments, wherein the fragrance material comprises a polymer having the fluid absorbed therein.

An eighth embodiment can include the mask of the seventh embodiment, wherein the polymer comprises a porous polymeric material.

A ninth embodiment can include the mask of any of the first to eighth embodiments, wherein the container and the fragrance material is exposed to an interior of the mask when the container is not engaged with the exhalation valve.

In a tenth embodiment, a method of determining an end of service life of a mask comprises exposing a fragrance material to an interior of a mask, where the fragrance material initially comprises a predetermined amount of fragrance composition, vaporizing the fragrance composition while the fragrance material is exposed to the interior of the mask, evaporating a predetermined quantity of the fragrance composition, and determining an end of service life of the mask based on evaporating the predetermined quantity of the fragrance composition.

An eleventh embodiment can include the method of the tenth embodiment, where the predetermined quantity corresponds to an amount of the fragrance composition being below an olfactory detection threshold.

A twelfth embodiment can include the method of the tenth or eleventh embodiment, wherein the fragrance material is retained in a container coupled to an interior surface of the mask.

A thirteenth embodiment can include the method of the twelfth embodiment, further comprising: engaging the container with an exhalation valve, wherein the exhalation valve is coupled to a surface of the mask, and wherein the fragrance material is retained between the container and the exhalation valve while the container is engaged with the exhalation valve, substantially preventing the vaporizing of the fragrance composition while the container is engaged with the exhalation valve, disengaging the container from the exhalation valve, and continuing to vaporize the fragrance composition after disengaging the container from the exhalation valve.

A fourteenth embodiment can include the method of the thirteenth embodiment, wherein the exhalation valve comprises a valve plate coupled to a valve base, and wherein substantially preventing vaporization of the fragrance composition comprises sealing the fragrance material in a closed chamber formed by the valve plate engaging the valve base and the valve base engaging the container.

A fifteenth embodiment can include the method of the thirteenth or fourteenth embodiment, wherein the mask comprises a center fold line defining a first half and a second half of the mask, wherein the exhalation valve is coupled to the first half, and where the container is coupled to the second half, and wherein engaging the container with the exhalation valve comprises folding the mask into a closed position.

A sixteenth embodiment can include the method of any of the tenth to fifteenth embodiments, further comprising: displaying a visual indication of a scent on an exterior of the mask, wherein the scent is provided by the fragrance composition.

In a seventeenth embodiment, a mask comprises a container coupled to a first surface of a mask, a fragrance material disposed in the container, wherein the fragrance material comprises a fragrance composition configured to evaporate from the fragrance material and provide a scent within an interior of the mask, and a visual indicator disposed on an outer surface of the mask, wherein the visual indicator corresponds to the scent provided by the fragrance composition.

An eighteenth embodiment can include the mask of the seventeenth embodiment, further comprising: an exhalation valve coupled to a second surface of the a mask, wherein the container is configured to releasably engage the exhalation valve to form a closed chamber, and wherein the closed chamber is configured to enclose the fragrance material when the container is releasably engaged with the exhalation valve.

A nineteenth embodiment can include the mask of the eighteenth embodiment, wherein the exhalation valve comprises an exterior cover, wherein an exterior surface of the exterior cover comprises a texture corresponding to the scent.

A twentieth embodiment can include the mask of any of the seventeenth to nineteenth embodiments, wherein an amount of the fragrance composition in the fragrance material is configured to evaporate over a time corresponding to a predetermined service life.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A mask comprising:

a container coupled to a first surface of a mask;

a fragrance material disposed in the container, wherein the fragrance material comprises a fluid configured to evaporate from the fragrance material and into an interior of the mask; and an exhalation valve coupled to a second surface of the mask, wherein the container is configured to releasably engage the exhalation valve to form a closed chamber in an instance in which the mask is folded along a center fold line, the closed chamber is configured to enclose the fragrance material when the container is releasably engaged with the exhalation valve, wherein the container is further configured to disengage the exhalation valve-to open the chamber to allow the fragrance material to evaporate in an instance in which the mask is unfolded, and wherein the exhalation valve is separate from the container, wherein the exhalation valve comprises a valve base and a valve plate coupled to the valve base, wherein the valve plate forms a seal with the valve base to seal the fragrance material, wherein the seal is adapted to prohibit evaporation of the fragrance material until the mask is unfolded.

2. The mask of claim 1, wherein the mask comprises the center fold line defining a first half and a second half of the mask, wherein the first surface is on the first half, and wherein the second surface is on the second half.

3. The mask of claim 2, wherein the exhalation valve is coupled to the first half, and wherein the container is coupled to the second half.

4. The mask of claim 1, wherein the container is configured to releasably engage the valve base.

5. The mask of claim 4, wherein the container is configured to releasably engage the valve base using a snap fit.

6. The mask of claim 4, wherein the closed chamber is formed between the valve plate, the valve base, and the container.

7. The mask of claim 1, wherein the fragrance material comprises a polymer having the fluid absorbed therein.

8. The mask of claim 7, wherein the polymer comprises a porous polymeric material.

9. The mask of claim 1, wherein the container and the fragrance material are exposed to an interior of the mask when the container is disengaged from the exhalation valve.

10. The mask of claim 1, further comprising a visual indicator disposed on an outer surface of the mask, wherein the visual indicator corresponds to a scent provided by the fragrance material.

11. A method of determining an end of service life of a mask, the method comprising:

exposing a fragrance material that is retained in a container coupled to an interior surface of a mask to an interior of the mask by unfolding the masks to disengage the container from an exhalation valve, wherein the fragrance material initially comprises a predetermined amount of fragrance composition;

engaging the container with the exhalation valve in an instance in which the mask is folded along a center fold line, wherein the exhalation valve is coupled to a surface of the mask, and wherein the fragrance material is retained between the container and the exhalation valve while the container is engaged with the exhalation valve, wherein the exhalation valve is separate from the container;

vaporizing the predetermined amount of fragrance composition while the fragrance material is exposed to the interior of the mask, wherein the exhalation valve comprises a valve base and a valve plate coupled to the valve base, wherein the valve plate forms a seal with the valve base to seal the fragrance material, prohibiting, via the seal, evaporation of the fragrance material until the mask is used;

evaporating a predetermined quantity of the predetermined amount of fragrance composition; and determining an end of service life of the mask based on evaporating the predetermined quantity of the predetermined amount of fragrance composition.

12. The method of claim 11, wherein the predetermined quantity corresponds to an amount of the predetermined amount of fragrance composition being below an olfactory detection threshold.

13. The method of claim 11, further comprising substantially preventing vaporization of the predetermined amount of fragrance composition by sealing the fragrance material in a closed chamber formed by the valve plate engaging the valve base and the valve base engaging the container.

14. The method of claim 11, wherein the mask comprises the center fold line defining a first half and a second half of the mask, wherein the exhalation valve is coupled to the first half, and wherein the container is coupled to the second half.

15. The method of claim 11, further comprising: displaying a visual indication of a scent on an exterior of the mask, wherein the scent is provided by the predetermined amount of fragrance composition.

16. A mask comprising:

a container coupled to a first surface of a mask;

a fragrance material disposed in the container, wherein the fragrance material comprises a fragrance composition configured to evaporate from the fragrance material and provide a scent within an interior of the mask;

a visual indicator disposed on an outer surface of the mask, wherein the visual indicator corresponds to the scent provided by the fragrance composition; and an exhalation valve configured to engage the container in an instance in which the mask is folded along a center fold line and to disengage the container in an instance in which the mask is unfolded, the exhalation valve comprising a valve base and a valve plate coupled to the valve base, wherein the valve plate forms a seal with the valve base to seal the fragrance material, wherein the seal is adapted to prohibit evaporation of the fragrance material until the mask is used wherein the exhalation valve is separate from the container.

17. The mask of claim 16, wherein the exhalation valve is coupled to a second surface of the mask, wherein the container is configured to releasably engage the exhalation valve to form a closed chamber, and wherein the closed chamber is configured to enclose the fragrance material when the container is releasably engaged with the exhalation valve.

18. The mask of claim 17, wherein the exhalation valve comprises an exterior cover, wherein an exterior surface of the exterior cover comprises a texture corresponding to the scent.

19. The mask of claim 16, wherein an amount of the fragrance composition in the fragrance material is configured to evaporate over a time corresponding to a predetermined service life.

* * * * *